United States Patent [19]

Young

[11] Patent Number: 4,503,777

[45] Date of Patent: Mar. 12, 1985

[54] SEMI-JACKETED BULLET HAVING INTEGRAL JACKET RETAINING MEANS, AND METHOD OF MAKING

[76] Inventor: Russell Young, R.D. 1, Box 119A, Broadalbin, N.Y. 12025

[21] Appl. No.: 316,933

[22] Filed: Oct. 30, 1981

[51] Int. Cl.[3] ..... F42B 11/08

[52] U.S. Cl. ..... 102/514; 102/507

[58] Field of Search ..... 102/514–519, 102/520–523, 501, 507–510, 524–527

[56] References Cited

U.S. PATENT DOCUMENTS

| | | | |
|---|---|---|---|
| 394,673 | 12/1888 | Bischoff et al. | 102/514 |
| 733,920 | 7/1903 | Scott | 102/514 |
| 1,081,065 | 12/1913 | Starkweather | 102/507 |
| 1,201,935 | 10/1916 | Campbell | 102/525 |
| 1,482,344 | 1/1924 | Briggs | 102/519 |
| 4,336,756 | 6/1982 | Schreiber | 102/507 |
| 4,384,529 | 5/1983 | Burns et al. | 102/525 |

FOREIGN PATENT DOCUMENTS

| | | | |
|---|---|---|---|
| 743914 | 1/1944 | Fed. Rep. of Germany | 102/514 |
| 6092 | 8/1906 | France | 102/520 |
| 14659 | of 1899 | United Kingdom | 102/510 |
| 103270 | 1/1917 | United Kingdom | 102/520 |

*Primary Examiner*—Harold J. Tudor

*Attorney, Agent, or Firm*—Paul I. Edelson

[57] ABSTRACT

A semi-jacketed molded bullet having means integral with the bullet core for preventing separation of the core from the jacket is disclosed. The bullet is particularly adapted for use in revolvers and comprises a cup-shaped jacket having a small hole in the bottom portion. A small portion of the bullet core material extends through the hole and forms a retaining flange exterior a portion only of the bottom of the jacket. In one embodiment, an annular member having a diameter slightly larger than the jacket is provided behind the jacket and held in place by the retaining flange of core material. The method of construction of the bullet of this invention comprises placing the jacket member into a bullet mold with the hole in the base facing upwardly, placing the annular member, if desired, upon the jacket base, and pouring molten core material through the opening to fill the mold and produce a small degree of over-flow to form the retaining flange.

10 Claims, 4 Drawing Figures

Fig. 1
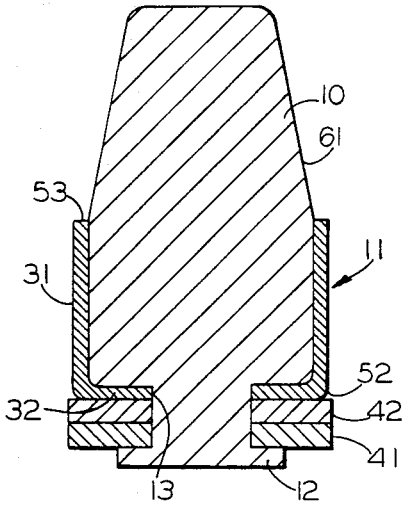
Fig. 2
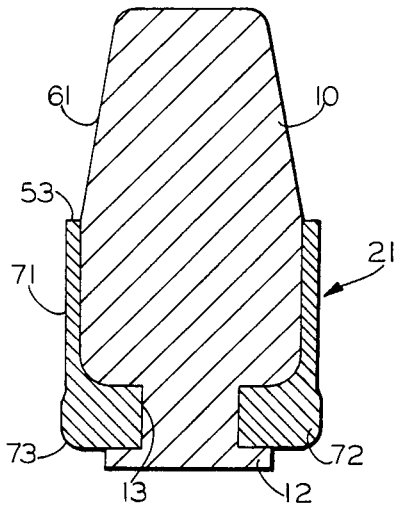
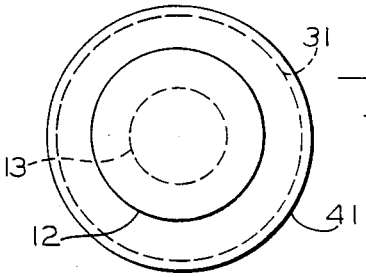
Fig. 3
Fig. 4
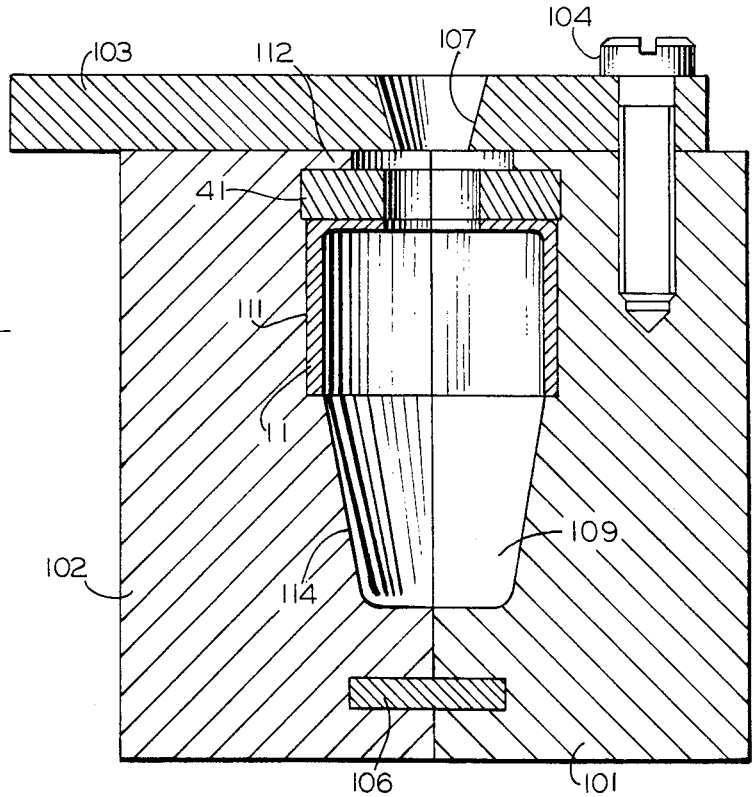

SEMI-JACKETED BULLET HAVING INTEGRAL JACKET RETAINING MEANS, AND METHOD OF MAKING

This invention relates to bullets. More particularly, this invention relates to semi-jacketed molded bullets particularly adapted for use with revolvers.

Upon firing in a revolver, a bullet leaves the chamber of the weapon and crosses a small gap prior to entering the barrel. In order to accept the fired bullet smoothly, the chamber end of revolver barrels are not formed as circular cylinders, but have a slightly conical posterior portion known as the forcing cone. The forcing cone guides the bullet into the rifling of the barrel. With prior art bullets, this results in what has been considered unavoidable fouling of the barrel by lead from the bullet, and the acceleration imparted to the leading edge of the bullet by the forcing cone causes the bullet to partially expand and lose shape in the mode known as "upsetting" of the base; this is characterized by the base of the bullet deforming, and wrapping forwardly the remainder of the bullet. This upsetting causes the bullet to decrease velocity through the barrel, and contributes to further fouling of the barrel.

In order to overcome some of the disadvantages of bullet fragmentation, the prior art had developed jacketed bullets in various forms. Basically, the prior art jacketed bullets comprise a core of relatively soft material, such as lead, the substance of conventional, unjacketed, bullets, surrounded, partially or completely, by a casing of a relatively harder material. For most applications, a fully jacketed bullet is too hard. Such a bullet will not deform, or mushroom, upon impact with its target, and may proceed cleanly through the target. This results in a portion of the momentum of the bullet not being transferred to the target, and, accordingly, substantially reduces the stopping power of the bullet. This invention does not relate to fully jacketed bullets. The prior art has also developed partially jacketed bullets in which at least a portion of the leading edge of the bullet is formed of the relatively soft core material, such as lead. The semi-jacketed bullet, in theory, allows for the construction of a mushrooming bullet of maximized stopping power. Difficulties have nevertheless been experienced in the prior art with partially jacketed bullets in the nature of separation between the core and jacket in flight, upsetting of the base in the barrel of the weapon, and in short jacket types excessive fouling of the weapon barrel by core material.

Two methods are known for the fabrication of bullets. In the first method, known as casting or molding, molten core material, such as lead, is poured into a mold defining the desired shape of the bullet, and the finished bullet is removed from the mold when cool. This method is simple and inexpensive The second method for fabricating bullets is known as swagging or extruding. In this method the bullet core material is worked mechanically into its desired shape while in the solid state. This method is much more complex, and costly. Several fairly statisfactorly semi-jacketed bullets have been made in the prior art by this second method. The prior art, however, has been unable to produce a fully satisfactory semi-jacketed molded bullet. All such attempts in the prior art have suffered from the difficulties of core/jacket separation, and/or of upsetting of the base upon firing.

It is, accordingly, an object of this invention to provide a molded, semi-jacketed, bullet.

Another object of this invention is to provide such a bullet which may be produced simply and inexpensively by both hand loading and mass production techniques.

It is another object of this invention to provide such a bullet having substantial mushrooming qualities.

It is another object of this invention to provide such a bullet which is particulary adapted to be fired in revolver-type weapons.

Yet another object of this invention is to provide such a bullet configured to eliminate lead fouling of the weapon barrel.

Still another object of this invention is to provide such a bullet in which the core and jacket will not separate in the weapon barrel, or in flight.

A further object of this invention is to provide such a bullet wherein the bullet core base is firmly contained within the jacket upon firing, and through traverse of the weapon barrel, so that upsetting of the base is eliminated.

Yet another object of this invention is to provide such a bullet having reduced friction with the weapon barrel to thereby increase muzzle velocity of the bullet.

Another object is to decrease the pressure exerted upon the barrel of a weapon by the bullet traveling therethough.

Briefly, and in accordance with one embodiment of this invention, a bullet comprises a core of relatively soft material and a cup-shaped jacket having a cylindrical upper portion and a circular base portion surrounding the posterior end of the core. The base portion of the jacket has an opening through which a small portion of core material, integral with the bullet core extends to form a retaining flange covering a portion only of the base portion of the jacket. The bullet is fabricated by placing the jacket member into a mold with the opening in the jacket base facing upwardly, and pouring molten core material into the mold through the opening in the jacket base until a small over-flow of core material is achieved.

The novel features of this invention sought to be patented are set forth with particularity in the appended claims. The invention, together with further objects and advantages thereof, may be understood from a reading of the following specification and appended claims in view of the accompanying drawings in which:

FIG. 1 is a cross-sectional view of a bullet in accordance with one embodiment of this invention.

FIG. 2 is a cross-sectional view of a bullet in accordance with an alternative embodiment of this invention.

FIG. 3 is a rear-end plan view of the bullet of FIG. 1.

As shown in FIG. 1, a bullet in accordance with this invention comprises a core 10 of a relatively soft material, such as lead, having a jacket, indicated generally at 11, conformably surrounding the posterior portion of core 10. Jacket 11 is formed of a relatively hard material such as copper, brass, zinc, bullet gilding material, or equivalent, with bullet gilding material being preferred. Jacket 11 comprises a cylindrical upper portion 31 and a circular base portion 32, preferably formed as a unitary stamping having a radius 52 at the juncture of cylindrical portion 31 and circular base portion 32. Jacket 11 is a thin jacket having a thickness of cylindrical upper portion 31 which is less than 10 percent of the diameter of the bullet. Base portion 32 of jacket 11 has a small opening 13 centrally located therein. Opening 13 is preferrably a circular hole, but any regular shaped opening providing symetry of the opening about the axis of the bullet is feasible in the practice of this invention.

In accordance with the preferred embodiment of this invention cylindrical portion 31 of jacket 11 has a diameter which exceeds, at all points, the maximum diameter of core 10, and provides a shoulder gap 53 at the junction of core 10 and jacket 11 at the forward end of jacket 11. From shoulder 53 forward, core 10 is preferrably conically shaped with cross sectionally straight sides 61. This construction eliminates contact between core 10 and the barrel of the weapon, thereby eliminating barrel fouling. Lead fouling of the barrel is eliminated by prevention of contact between the core and the barrel as aforesaid. It has also been found, with the use of fully jacketed bullets in the prior art, that some degree of copper fouling of the barrel of a weapon may be caused when a jacket consisting of, or containing, copper is used. In the embodiment of this invention employing annular zinc members, as described particularly hereinbelow, it has been found that even when the preferred jacket material, bullet gilding material, is employed, copper fouling of the barrel is also eliminated. This appears to be the result of the cleaning of any material from the barrel by the zinc washers passing therethrough, and the deposition upon the inner surface of the weapon barrel of a desirable thin coating of zinc. This construction also eliminates the problem experienced in the prior art of core material tending to be deformed backwardly over the forward edge of the semi-jacket and lost during projectile penetration of the target. Additionally, shoulder 53 provides for the support of the lead core during expansion or maintenance by jacket 11 of its shape at the instant of impact of the bullet with its target so that maximum mushrooming is achieved.

In accordance with the preferred embodiment of this invention illustrated in FIG. 1, annular members 41 and 42 are provided posteriorly circular base portion 32 of jacket member 11. Annular members 41 and 42 have their central openings disposed coaxially hole 13 in circular base portion 32 of jacket 11. Annular members 41 and 42 may be formed of any suitable material such as zinc, copper, or brass, with zinc being preferred as the least expensive suitable material and the material least likely to harmfully abrade the weapon barrel. In the embodiment of this invention actually reduced to practice, annular members 41 and 42 were commercially available zinc washers. Obviously, a single annular member of appropriate thickness could be employed within the scope of this invention, but in using commercially available washers, two were required for achievement of appropriate thickness. The major diameter of annular members 41 and 42 is preferrably is 0.001 to 0.002 inch greater than the outer diameter of cylindrical portion 31 of jacket member 11. In a bullet constructed in accordance with this invention as disclosed immediately hereinabove, annular members 41 and 42 perform a number of advantageous functions. Being slightly larger than the jacket, the annular members function in the weapon barrel analogously to piston rings in an internal combustion engine and form a nearly perfect pressure seal behind the bullet in the barrel, while simultaneously decreasing the total contact area between the bullet and the barrel, minimizing frictional forces retarding the passage of the bullet through the barrel, and having the combined effect of substantially increasing muzzle velocity of the bullet. The annular members, being formed of a material lighter than lead, have the further effect of moving the balance point of the bullet forwardly, thereby improving flight stability of the bullet.

The annular members employed have an outer diameter at least equal to the bore diameter of the weapon in which the bullet of this invention is intended to be fired. The provision of a jacket having an outer diameter 0.001 to 0.002 inch less than the annular member may be accomplished conveniently by using jacket blanks intended for the production of semi jacketed bullets by swagging or extrusion. These blanks are intentionally formed 0.001 to 0.002 inch thinner than their intended bore diameter because this much expansion is intentionally created in the extrusion fabrication process to create a structure in which the core is hopefully elastically retained within the jacket. By decreasing the weight of a bullet of a given size, annular members 41 and 42 also serve to increase the stopping power of the bullet by increasing the velocity which will be imparted by a given charge. The principal advantage provided by annular members 41 and 42 is substantial mechanical strengthening of the base portion of jacket member 11 to completely eliminate any possibility of upsetting of the base of the bullet, which has been a particularly annoying problem with prior art bullets.

The entire assembly of the bullet of this invention, as shown in FIG. 1, is firmly mechanically secured together by a small quantity of the material of core 10 extending through opening 13 in base portion 32 of jacket 11, across the inner openings of annular members 41 and 42, for a distance of less than 20% of the length of the bullet, and forming retaining flange 12 across a portion of the rearmost surface of the bullet assembly. Because retaining flange 12 is completely integral with core 10, it is completely impossible for the core and jacket of a bullet constructed in accordance with this invention to separate. Upon firing of the cartridge containing the bullet of FIG. 1, the majority of the propelling force of the charge is applied against washer 41, and the bullet moves down the barrel of the weapon under the impetus of this force such that flange 12 can not be blown back through opening 13 because the pressure differential which would be required to do so is absent. As stated previously, washer members 41 and 42 provide an extemely strong bullet base such that the only deformation of the bullet which can occur upon firing is the deforming of radius 52 of jacket 11 to conform to the adjacent face of washer 42.

At the initial moment of firing from a cartridge, a bullet exhibits inertia of rest. The initial force of the charge is concentrated at the base of the bullet. In the bullet of this invention, this impulse is absorbed in the deforming of radius 52 to conform to the adjacent face of washer 42. Because of the absorbtion of the impulse by radius 52, during the instant in which the bullet is brought into motion, expansion, or upsetting of the base is completely eliminated. In all prior art bullets, at least some expansion of the base occurs upon firing as a result of the absorbtion by the bullet of the initial firing impulse prior to the overcomming of the inertia of the rest of bullet.

An alternative embodiment of this invention is illustrated in FIG. 2. A functionally equivalent bullet to that shown in FIG. 1 and described hereinabove may be constructed by replacing jacket member 11 and annular members 41 and 42, as shown in FIG. 1, with jacket member 21 as shown in FIG. 2. Jacket member 21 may be formed of any of the materials described above for forming jacket member 11 and has a cylindrical portion 71 which is structurally identical to cylindrical portion 31 of jacket 11. Circular base portion 72 of jacket 21, on the other hand, is formed to have a thickness substantially greater than that of cylindrical portion 71, as contrasted with jacket 11 in which circular base portion 32 has the same thickness as cylindrical portion 31. The thickening of base portion 72 of jacket 21 provides, in a unitary jacket member, the strengthened and stiffened base provided by the combination of circular base 32 and annular members 41 and 42, in the embodiment of FIG. 1. The advantages described in relation to FIG. 1 of having the major diameter of annular members 41 and 42 slightly exceeding the outer diameter of cylindrical portion 31 of jacket 11 may be provided in the embodiment of FIG. 2 by forming circular base portion 72 of jacket 21 with peripheral ridge 73 of 0.001 to 0.002 inch thickness. In the embodiment of FIG. 2, core 10 is identical with core 10 as shown in FIG. 1, and circular base portion 72 of jacket 21 has a central opening 13 therethrough analogous to that shown in FIG. 1. A retaining flange 12, formed of, and integral with, the material of core 10 is provided on the posterior surface of circular base member 72 of jacket 21 precisely analogously with the flange described hereinabove with reference to FIG. 1. Similarly, the anterior end of core 10 of the bullet of FIG. 2 is formed as a truncated conical segment having conical surface 61 intersecting the inner surface of jacket 21 to form a shoulder gap 53 as also shown in FIG. 1 and more particularly described hereinabove. The choice between the embodiment of FIG. 1 and the embodiment of FIG. 2 is a design choice, each embodiment having its particular advantages and disadvantages with respect to the other. Jacket 11 may be conveniently formed by stamping readily advailable stock material, whereas jacket 21 must be formed by a more complicated and costly process such as casting, extruding, or milling. The bullet of FIG. 2, having only two parts, requires fewer process steps in its manufacture, and in providing a jacket and thickened base formed integrally, may be theoretically stronger.

Shoulder gap 53, as shown in FIGS. 1 and 2 functions to retain the entire mass of the bullet to maximize its stopping power, as well as to completely prevent lead fouling of a weapon barrel. Upon impact with a target, the core of the bullet begins to deform, as is known in the art. Gap 53 prevents any of the material of core 10 from overflowing the jacket, and becoming lost as occurs with prior art bullets. The forces exerted by the deformation of core 10 upon impact with a target cause cylindrical portion 31 or 71 of the jacket to begin expansion prior to reaching the shoulder of the jacket. Thus, the bullet of this invention retains its physical integrity throughout its passage through its target.

Because of the retaining of the jacket of the bullet of this invention by retaining flange 12, formed integrally with core 10, no separation between the core and jacket occurs even during penetration of a target. Therefore, the complete retention of the jacket provided by flange 12, in conjunction with the complete retention of core material provided by shoulder gap 53, results in extremely efficient mushrooming of the bullet within the target, with essentially no loss of mass, thereby providing maximum stopping power. Bullets in accordance with this invention have been test fired at a wide variety of targets, and have uniformly been found to exhibit none of the degradation experienced with prior art bullets.

The method of fabrication of bullets in accordance with this invention, by hand-molding techniques, may be understood with reference to FIG. 4. FIG. 4 shows, in cross section, mold segments 101 and 102 which fit together to form the mold aligned by aligning pin 106 in segment 101 mating with an aligning hole in segment 102, as is known in the art. As is further known in the art, the upper-most member of the mold is spru plate 103 which is attached to segment 101 by a removable pin type member, which may be a machine screw, such that spru plate 103 may be moved rotationally about the pivot point provided by screw or other pin member 104. When fully assembled, segments 101 and 102, and spru plate 103 define cavity 109 in which the bullet will be molded. Cavity 109 is completely enclosed accept for pour hole 107 in spru plate 103 disposed coaxially cavity 109. Pour hole 107 is formed with angled sides to form a sharp cutting edge for shearing off any excess core material which may have been poured. Mold blocks 101 and 102 in accordance with this invention define a cavity 109 having a bullet nose portion 114 and an offset base portion 111 for molding a Keith-style bullet as is known in the art.

The mold in accordance with this invention differs from the mold for the known Keith-style bullet only in having mold block intrusion 112 extending into the volume which would be the upper part of the cavity in the conventional Keith-style bullet mold. In the Keith-style bullet mold, the off-set base portion is provided to create a bullet having a sharp shoulder for maximum tissue tearing upon impact with the target. In the prior art Keith bullet mold, portion 111 extends upwardly in a straight line to the top of the mold blocks directly abutting the spru plate. In the forming of a prior art Keith style bullet, a mold is assembled as shown in FIG. 4, and molten lead is poured through pour hole 107 to substantially fill cavity 109. When the lead has cooled and solidified, the mold is opened by swinging the spru plate aside about pin 104, and then separating segments 101 and 102 to remove the finished bullet. Any excess lead is sheared away by the beveled edge of pour hole 107 as discussed hereinabove, leaving a bullet having smooth surfaces.

In accordance with this invention, a bullet is formed by inserting into an open mold cavity a jacket member, such as jacket member 11 or 21, with cylindrical portion 31 or 71 downwardly such that hole 13 in the base portion of the jacket is co-linear with the position which will be occupied by pour hole 107 when the mold is closed, and, if the embodiment illustrated in FIG. 1 is to be constructed, placing over the exposed base portion of the jacket member an annular member 41, or annular members 41 and 42. The spru plate is then closed, and molten core material, such as lead is poured through pour hole 107 until the entire cavity is filled so that a continuous quanity of lead forms the bullet core, the retaining flange, and the shaft therebetween. The mold assembly is then allowed to cool in the normal manner, and when cooled, is opened and the bullet removed, again in the manner known in the prior art. It should be apparent to those skilled in the art that the length of the jacket member, and the thickness of the annular member or members are preferably such as to fully occupy the distance from the off-set in the Keith-style bullet mold to the lower surface of intrusion 112, with a sufficiently tight pressure fit so that, upon pouring, no lead will flow into the the juncture between jacket member 11 and the annular member, between sucessive annular embers, or between the upper surface of the annular member or members and intrusion 112, or between jacket member 71 and intrusion member 112.

While this invention has been described with reference to particular embodiments and examples, other variations and modifications will occur to those skilled in the art in view of the above teachings. Accordingly, it should be understood that within the scope of the appended claims, the invention may be practiced otherwise than specifically disclosed.

I claim:

1. A molded bullet comprising:

a core of soft metal material having a nose end and a base end;

a cup shaped jacket of material harder than said soft metal material having a cylindrical upper portion and a circular base portion substantially surrounding said base end of said core and so surrounding said core to prevent contact between said soft metal material and a weapon barrel upon firing said bullet through said barrel and having an opening in said base portion; wherein the distance between inner and outer surfaces of said cylindrical upper portion is less than ten percent of the diameter of said bullet; and a retaining flange of said soft metal material, formed integrally with said core, extending through said opening for a distance less than twenty percent of the length of said bullet and overlying a portion only of said base portion to prevent contact between said flange and said weapon barrel.

2. A bullet as claimed in claim 1 wherein said nose end of said core is a truncated cone in shape having an apex and a base and having its apex at the anterior end of said bullet.

3. The bullet of claim 2 wherein said cylindrical upper portion of said jacket extends from said circular base portion at least to the base of said truncated cone.

4. A bullet as claimed in claim 1 wherein the diameter of said circular base portion exceeds the outer diameter of said cylindrical upper portion.

5. The bullet of claim 4 wherein the thickness of said circular base portion exceeds the thickness of said cylindrical upper portion.

6. A bullet as claimed in claim 1 wherein said retaining flange overlies a portion only of said base portion in spaced relation thereto and further comprising:

at least one annular member disposed between said jacket and said retaining flange.

7. The bullet of claim 6 wherein the central opening of said annular member is congruent with, and disposed coaxially with, said opening in said base portion.

8. The bullet of claim 6 wherein the outer diameter of said annular member exceeds the outer diameter of said jacket.

9. The bullet of claim 6 wherein the aggregate thickness of said at least one annular member exceeds the thickness of said jacket.

10. The bullet of claim 6 wherein said at least one annular member is a zinc member.

* * * * *